US005485664A

United States Patent [19]

Huang

[11] Patent Number: 5,485,664

[45] Date of Patent: Jan. 23, 1996

[54] METHOD FOR PRODUCING GLOBE-SHAPED BELLS WITH SINGLE PIECE SHELLS

[76] Inventor: Chung-Shyan Huang, No. 1-1, Chang Mar Street, Hsiu Shui Hsiang, Chang Hua Hsien, Taiwan

[21] Appl. No.: 402,462

[22] Filed: Mar. 10, 1995

[51] Int. Cl.[6] ..... B29D 17/00

[52] U.S. Cl. ..... 29/169.5; 72/404

[58] Field of Search ..... 29/169.5; 72/404; 84/103; 116/148, 149

[56] References Cited

U.S. PATENT DOCUMENTS 203,675 5/1878 Tucker ..... 29/169.5

3,338,084 8/1967 Stegman ..... 72/404

4,180,008 12/1979 Nakamoto ..... 116/170

*Primary Examiner*—P. W. Echols

*Attorney, Agent, or Firm*—Charles E. Baxley

[57] ABSTRACT

A method for manufacturing a bell continuously and automatically with a number of mold pieces which are movable downward toward a lower mold having a number of mold cavities for engaging with one half of the bell. A plate member is fed step by step through the lower mold and the mold pieces so as to be formed into the bells. The mold pieces are arranged in series so as to form a recess in the plate member, to form four blades, to bend the blades, to feed a sounder into the bell, and to bend the blades again so as to form the outer half of the bell, and to disengage the bell from the plate member.

3 Claims, 3 Drawing Sheets

METHOD FOR PRODUCING GLOBE-SHAPED BELLS WITH SINGLE PIECE SHELLS

BACKGROUND OF THE INVENTION

1. Field of the Invention

The present invention relates to a method, and more particularly to a method for producing a glove-shaped bells with single piece shells.

2. Description of the Prior Art

Typically, bells are made by a number of processes and a number of molds. In addition, a number of operators are required to process the manufacturing processes. Particularly, the clapper or sounder is required to be engaged in the bells manually.

The present invention has arisen to mitigate and/or obviate the afore-described disadvantages of the conventional methods for manufacturing bells.

SUMMARY OF THE INVENTION

The primary objective of the present invention is to provide a method which may produce bells in a continuous way.

In accordance with one aspect of the invention, there is provided a method for manufacturing a bell including a first half having an eye formed therein and a second half having four blades formed therein and having a cross shaped groove formed therein, the method comprising preparing a mold assembly comprising a lower mold including a plurality of first mold cavities formed therein for engaging with the first half of the bells, and comprising a plurality of mold pieces movable downward toward the lower mold, and feeding a plate member step by step through the mold assembly. The first of the mold pieces are provided to form three slits in the plate member so as to define a unit in the plate member, a pair of second of the mold pieces are provided for forming a pair of positioning holes in the plate member, a third of the mold pieces is provided for forming a recess in the unit, a fourth of the mold pieces is provided for forming the blades, the blades are coupled to the plate member by at least one coupling portion, a fifth of the mold pieces is provided for forming the eye in the first half of the bell, a sixth of the mold pieces is provided for bending the blades, a seventh of the mold pieces includes an aperture formed therein for supplying a sounder into the first half of the bell, an eighth of the mold pieces includes a second mold cavity formed therein for bending the blades so as to form the second half of the bell, and a ninth of the mold pieces is provided for cutting the coupling portion so as to disengage the bell from the plate member.

The seventh mold piece includes a third mold cavity for engaging with the blades, a shaft slidably engaged in the aperture, a passage formed therein and communicating with the aperture, a wire slidably engaged in the passage, means for feeding the wire into the aperture, the wire engaged in the aperture is cut by the shaft for moving through the aperture into the first half of the bell.

The fifth mold piece includes a projection for engaging with the plate member so as to form the eye in the first half of the bell.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
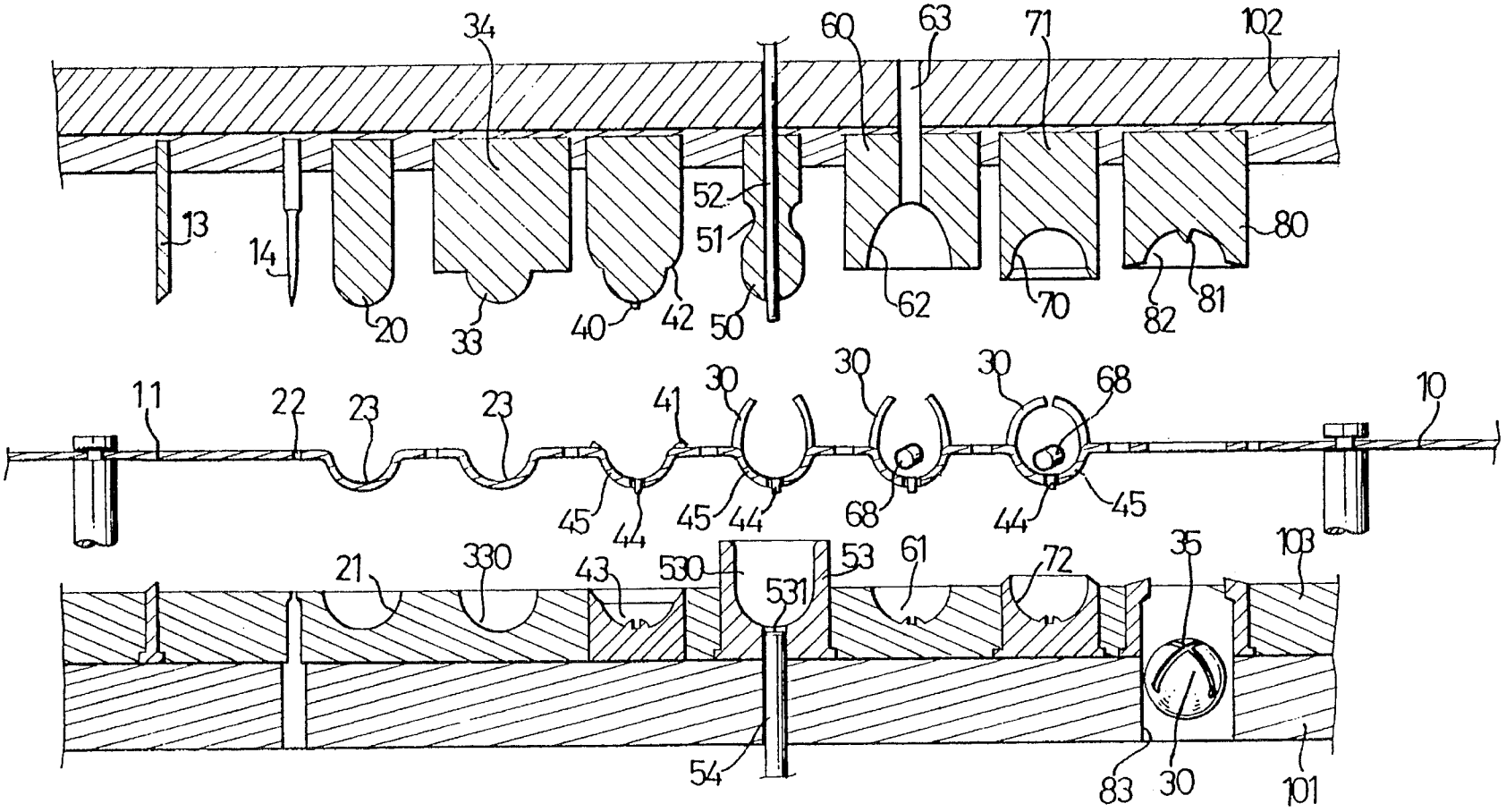
FIG. 1 is a cross sectional view illustrating a method in accordance with the present invention.
Figure 3:
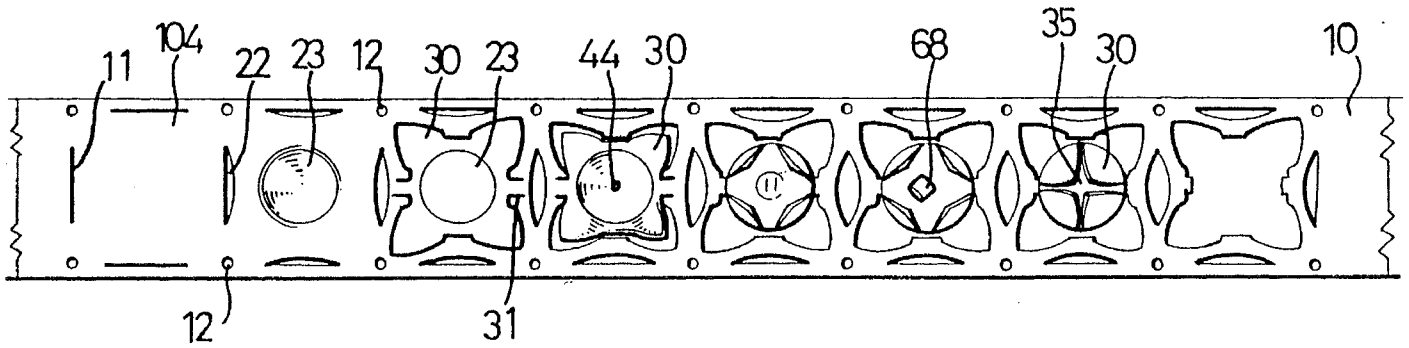
FIG. 3 is a top view of the plate member.
Figure 2:
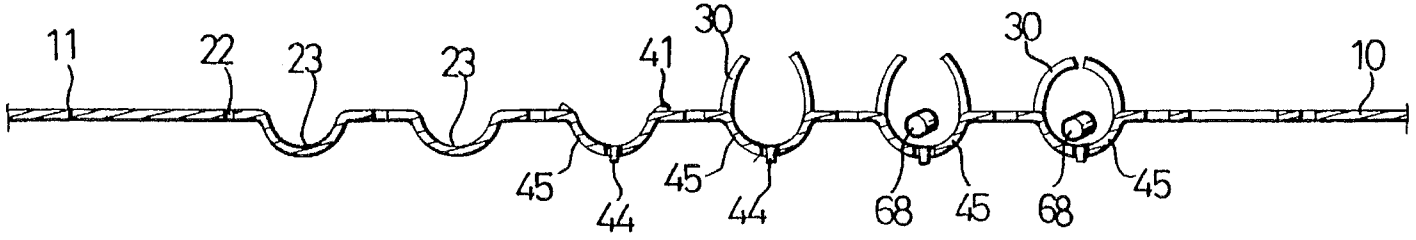
FIG. 2 is a cross-sectional view of a plate member to be molded into the bells.

Referring to the drawings, and initially to FIGS. 1 to 3, a method in accordance with the present invention is provided for automatically manufacturing bells and comprises a mold assembly 101, 102 for conducting the following processes.

The mold assembly includes a base 101 and a block 102 movable downward toward the base 10. A lower mold 103 is secured on the base 101 and includes a number of mold cavities 21, 330, 43, 61, 72 formed therein and arranged in series. A plate member 10 to be manufactured into the bells is disposed between and fed step by step through the lower mold 103 and the block 102. A number of mold pieces 13, 20, 34, 42, 50, 62, 70, 80 are secured to the block 102 and movable downward toward the lower mold 103 for engaging with the mold cavities so as to mold the plate member 10.

Three mold pieces 13 are provided for punching three slits 11 in the plate member 10, in which two slits 11 are extended longitudinally in the side portions of the plate member 10, and the other slit 11 is extended perpendicular to the longitudinal axis of the plate member 10 so as to define a square unit 104. A number pairs of positioning pins 14 are secured to the block 102, in which a first pair of pins 14 are provided for punching positioning holes 12 in the plate member 10, and the other pins are engagable with the positioning holes 12 for positioning the plate member 10. Mold piece 20 and mold cavity 21 are provided for forming a semi-spherical recess 23 in the unit 104. The slits 11 are slightly enlarged to larger slit 22 when molding the recess 23. Mold piece 34 is provided for punching the unit 104 so as to form four blades 30 which are secured to the plate member 10 by two coupling portions 31. The mold piece 34 includes a bulge 33 for engaging with the recess 23 and the mold cavity 330 of the lower mold 103 so as to further position the plate member 10.

Figure 5:
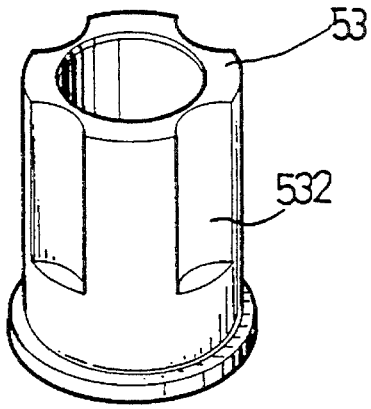
FIG. 5 is a perspective view showing one mold piece of the mold assembly.

Mold piece 42 is provided for engaging with the recess 23 and the mold cavity 43 and includes a projection 40 for forming an eye 44 in the center of the recess 23 so as to form a first half 45 of a bell. A mold piece 53 is secured in the lower mold 103 and includes a mold cavity 530 formed therein for engaging with the first half 45 of the bell, and includes an orifice 531 formed in the mold cavity 530 for slidably engaging with a rod 54. As shown in FIG. 5, four depressions 532 are formed in the outer peripheral portion of the mold piece 53. Mold piece 50 is secured to the block 102 for engaging and for forcing the first half 45 into the mold cavity 530 of the mold piece 53 so as to fold the blades 30 upward. The eye 44 may be engaged in the orifice 531. The mold piece 50 includes a neck portion 51 of reduced diameter for receiving the free end portions of the blades 30. A post 52 is slidably engaged in the mold piece 50 for disengaging the plate member 10 from the mold piece 50. The rod 54 is provided for pushing the eye 44 so as to disengage the plate member 10 from the lower mold 103.

Figure 4:
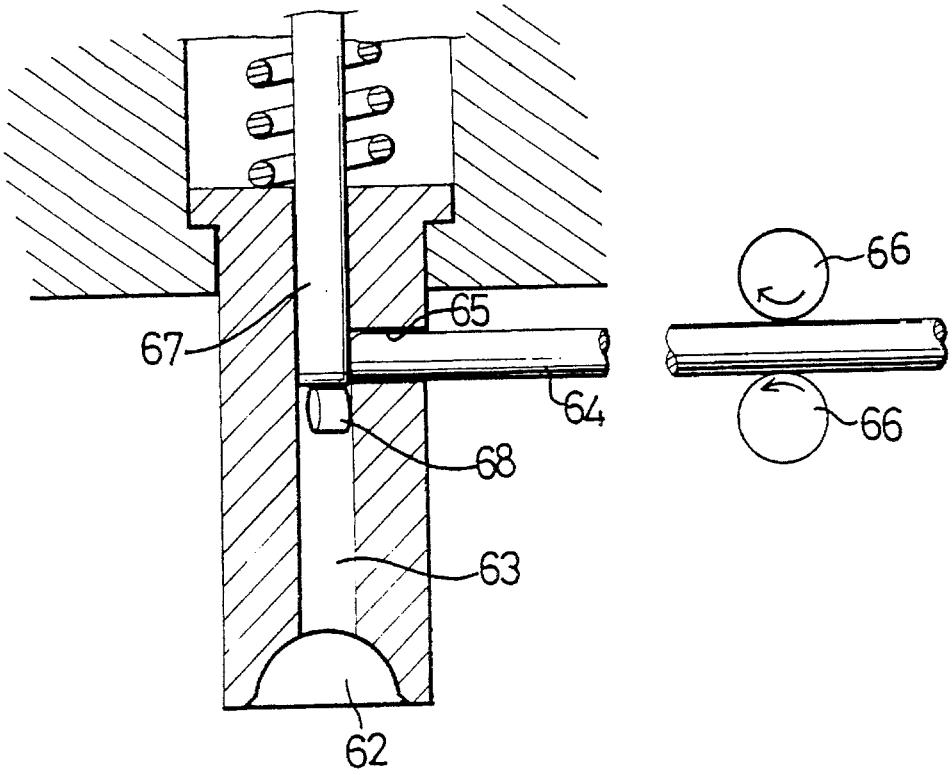
FIG. 4 is a cross sectional view illustrating the formation of the clapper or sounder.

The first half 45 of the bell may be engaged in the next mold cavity 61. Mold piece 60 is disposed after mold piece 50 and includes a mold cavity 62 for engaging with the blades 30 so as to bend the blades 30, and includes an aperture 63 formed therein for slidably engaging with a shaft 67, as shown in FIG. 4. A passage 65 is laterally formed in the mold piece 60 and communicating with the aperture 63 for supplying a wire 64 into the aperture 63. The wire 64 is fed into the aperture 63 by roller means 66. The end portion of the wire 64 which is engaged in the aperture 63 is cut by the shaft 67 so as to form a clapper or a sounder 68 which is dropped into the first half 45 from the aperture 63. Another mold piece 71 includes a mold cavity 70 for engaging with and for bending the blades 30 into semi-spherical shape which is the second half of the bell. At this moment, the first half 45 is engaged in the mold cavity 72. The last mold piece 80 includes a protrusion 81 formed in the mold cavity 82 for engaging with the intersection portion of the cross-shaped groove 35 formed between the blades 30 so as to position and center the blades 30. The mold piece 80 is provided for cutting the coupling portions 31 so as to disengage the bell from the plate member 10. A conduit 82 is formed in the lower mold 103 for receiving the bells disengaged from the plate member 10.

Accordingly, bells may be automatically and continuously manufactured by the mold assembly and by the method in accordance with the present invention. The plate member may be fed into the mold assembly step by step and may be processed by the mold assembly so as to form the bells. The clapper or the sounder 68 may also be engaged in the bells automatically without manual force.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A method for manufacturing a bell including a first half having an eye formed therein and a second half having four blades formed therein and having a cross shaped groove formed therein, said method comprising:

preparing a mold assembly comprising a lower mold including a plurality of first mold cavities formed therein for engaging with said first half of said bells, and comprising a plurality of mold pieces movable downward toward said lower mold, and feeding a plate member step by step through said mold assembly, wherein the first of said mold pieces are provided to form three slits in said plate member so as to define a unit in said plate member, a pair of second of said mold pieces are provided for forming a pair of positioning holes in said plate member, a third of said mold pieces is provided for forming a recess in said unit, a fourth of said mold pieces is provided for forming said blades, said blades are coupled to said plate member by at least one coupling portion, a fifth of said mold pieces is provided for forming said eye in said first half of said bell, a sixth of said mold pieces is provided for bending said blades, a seventh of said mold pieces includes an aperture formed therein for supplying a sounder into said first half of said bell, an eighth of said mold pieces includes a second mold cavity formed therein for bending said blades so as to form said second half of said bell, and a ninth of said mold pieces is provided for cutting said coupling portion so as to disengage said bell from said plate member.

2. A method according to claim 1, wherein said seventh mold piece includes a third mold cavity for engaging with said blades, a shaft slidably engaged in said aperture, a passage formed therein and communicating with said aperture, a wire slidably engaged in said passage, means for feeding said wire into said aperture, said wire engaged in said aperture is cut by said shaft for moving through said aperture into the first half of said bell.

3. A method according to claim 1, wherein said fifth mold piece includes a projection for engaging with said plate member so as to form said eye in said first half of said bell.

* * * * *